US005549358A

United States Patent [19]

Müller

[11] Patent Number: 5,549,358

[45] Date of Patent: Aug. 27, 1996

[54] SEAT

[75] Inventor: Anton Müller, Aalen, Germany

[73] Assignee: Eisen- und Drahtwerk Erlau Aktiengesellschaft, Aalen, Germany

[21] Appl. No.: 330,076

[22] Filed: Oct. 26, 1994

[30] Foreign Application Priority Data

Oct. 26, 1993 [DE] Germany ..... 9316299 U

[51] Int. Cl.[6] ..... A47C 7/02

[52] U.S. Cl. ..... 297/452.64; 297/452.19; 297/452.52

[58] Field of Search ..... 297/452.63, 452.64, 297/452.20, 452.19, 452.18, 452.42, 452.46, 452.52

[56] References Cited

U.S. PATENT DOCUMENTS

| | | | |
|---|---|---|---|
| 2,169,197 | 8/1939 | Reed | 297/452.18 |
| 2,281,341 | 4/1942 | Turner | 297/452.19 X |
| 2,708,476 | 5/1955 | Eames | 297/452.64 |
| 3,117,775 | 1/1964 | Hamilton et al. | 297/452.63 X |
| 3,147,998 | 9/1964 | Hamilton | 297/452.64 |
| 3,709,559 | 1/1973 | Rowland | 297/452.63 X |
| 3,774,967 | 11/1973 | Rowland | 297/452.64 |
| 4,062,590 | 12/1977 | Polsky et al. | 297/452.64 X |
| 4,299,645 | 11/1981 | Newsom | 297/452.64 X |

FOREIGN PATENT DOCUMENTS

| | | | |
|---|---|---|---|
| 2521411 | 8/1983 | France | 297/452.18 |
| 3223321 | 3/1983 | Germany | 297/452.64 |
| 1580945 | 12/1980 | United Kingdom | 297/452.63 |

*Primary Examiner*—Peter M. Cuomo
*Assistant Examiner*—David E. Allred
*Attorney, Agent, or Firm*—Robert W. Becker & Associates

[57] ABSTRACT

The seat has a seat portion with a seat frame and a seat surface comprised of a first wire mesh. The seat also has a seat back having a back frame and a back support surface comprised of a second wire mesh. The first wire mesh is comprised of first wires with distal ends. The seat frame has inner sides facing one another and the distal ends of the first wires are connected to the inner sides of the seat frame. The second wire mesh is comprised of second wires with distal ends. The back frame has inner sides facing one another and the distal ends of the second wires are connected to the inner sides of the back frame.

20 Claims, 3 Drawing Sheets

SEAT

BACKGROUND OF THE INVENTION

The present invention relates to a seat with a seat portion and a seat back each having respectively a seat surface and a back support surface that are formed by a wire mesh whereby the distal ends of the wires are at least partially connected to the respective frame.

In seats of the aforementioned kind the wires of the wire mesh which form the seat surface and the back support surface are connected to the respective frame. During manufacture of such seats the distal ends of the wires, after attachment to the frame, must be cut off so that the projecting distal ends of the wires do not result in damage to clothing of persons sitting on the seat. The manufacture of such seats is expensive and complicated. Furthermore, it cannot be completely prevented that even after removal of projecting distal ends of wires at the seat surface and the back support surface sharp edges, formed by cutting off the wires, are present which can also result in damage to clothing.

It is therefore an object of the present invention to provide a seat of the aforementioned kind such that it can be manufactured in a simple and inexpensive manner and such that damage to clothing is completely prevented.

SUMMARY OF THE INVENTION

The seat of the present invention is primarily characterized by:

A seat portion having a seat frame and a seat surface comprised of a first wire mesh;

A seat back having a back frame and a back support surface comprised of a second wire mesh;

Wherein the first wire mesh is comprised of first wires with distal ends;

Wherein the seat frame has inner sides facing one another;

Wherein the distal ends of the first wires are connected to the inner sides of the seat frame;

Wherein the second wire mesh is comprised of second wires with distal ends;

Wherein the back frame has inner sides facing one another; and

Wherein the distal ends of the second wires are connected to the inner sides of the back frame.

Preferably, the distal ends of the first and second wires are bent substantially at right angles to form bent portions.

Expediently, the distal ends of the second wires are bent rearwardly. Advantageously, the distal ends of the first wires are bent downwardly.

Advantageously, the bent portions of the distal ends extend substantially over half of thickness of the seat frame and back frame.

Preferably, the seat frame comprises a forward frame portion and lateral frame portions, connected to the forward frame portion, and a transverse stay connected between the lateral frame portions, wherein the transverse stay limits the seat surface relative to the seat back.

Advantageously, the first wires are comprised of a first set and a second set, wherein the distal ends of the first set, that extend away from the forward frame portion, are connected to the transverse stay.

In a preferred embodiment of the present invention, the transverse stay, on a side thereof facing away from the seat surface, has a depression into which depression the distal ends of the first set extend.

Advantageously, the depression has a depth equal to the thickness of the distal ends of the first set of wires extending into the depression.

Preferably, the back frame comprises an upward frame portion and lateral frame portions, connected to the upward frame portion, and a transverse stay connected between the lateral frame portions, wherein the transverse stay limits the back support surface relative to the seat portion.

Advantageously, the second wires are comprised of a first set and a second set, wherein the ends of the first set, that extend away from the upward frame portion, are connected to the transverse stay. Preferably, the transverse stay, on a side thereof facing away from the back support surface, has a depression into which depression the distal ends of the first set extend.

Advantageously, the depression has a depth equal to a thickness of the distal ends of the first set that extends into the depression.

In a preferred embodiment of the present invention, the upward frame portion and the forward frame portion are curved with different curvatures. Expediently, the seat frame and the back frame together are a unitary part.

Advantageously, the upward frame portion has a smaller radius of curvature than the forward frame portion.

Expediently, the transverse stay of the seat portion extends in a plane parallel to the forward frame portion.

Preferably, the transverse stay of the seat back extends in a plane parallel to the upward frame portion.

Expediently, the seat surface has the same radius of curvature as the forward frame portion.

The back support surface may also have the same radius of curvature as the upward frame portion.

In a preferred embodiment of the present invention, the lateral frame portions of the seat frame and the lateral frame portions of the back frame are arranged in common planes.

Preferably, the lateral frame portions of the seat frame have an arc-shaped transition into the lateral frame portions of the back frame.

Preferably, the forward frame portion, when viewed in a top view of the seat surface, extends straight.

The inventive seat has the advantage that the distal ends of the wires are not connected to the upper side of the seat portion or of the seat back but are connected to inner sides of the frame portions that are facing one another. Thus, it is prevented that the distal ends of the wires come into contact with the clothing of the person sitting down on the seat. Accordingly, damage to the clothing is prevented. Due to the inventive embodiment the distal ends of the wires no longer must be cut off since they are positioned in the area between the frame portions. This allows for a simple and inexpensive manufacture of the seat.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1–6.

Figure 1:
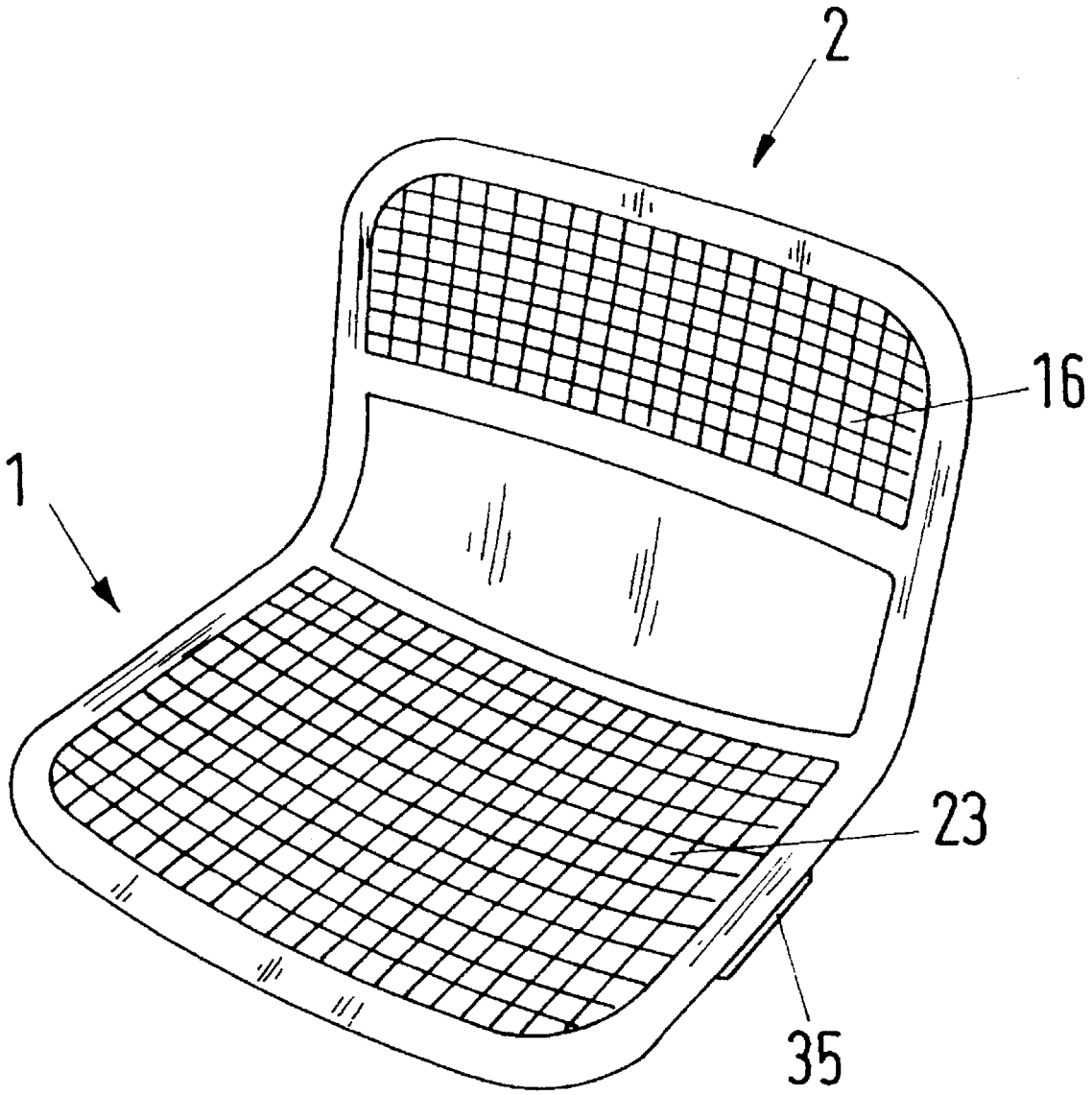
FIG. 1 shows the inventive seat in a perspective representation.
Figure 2:
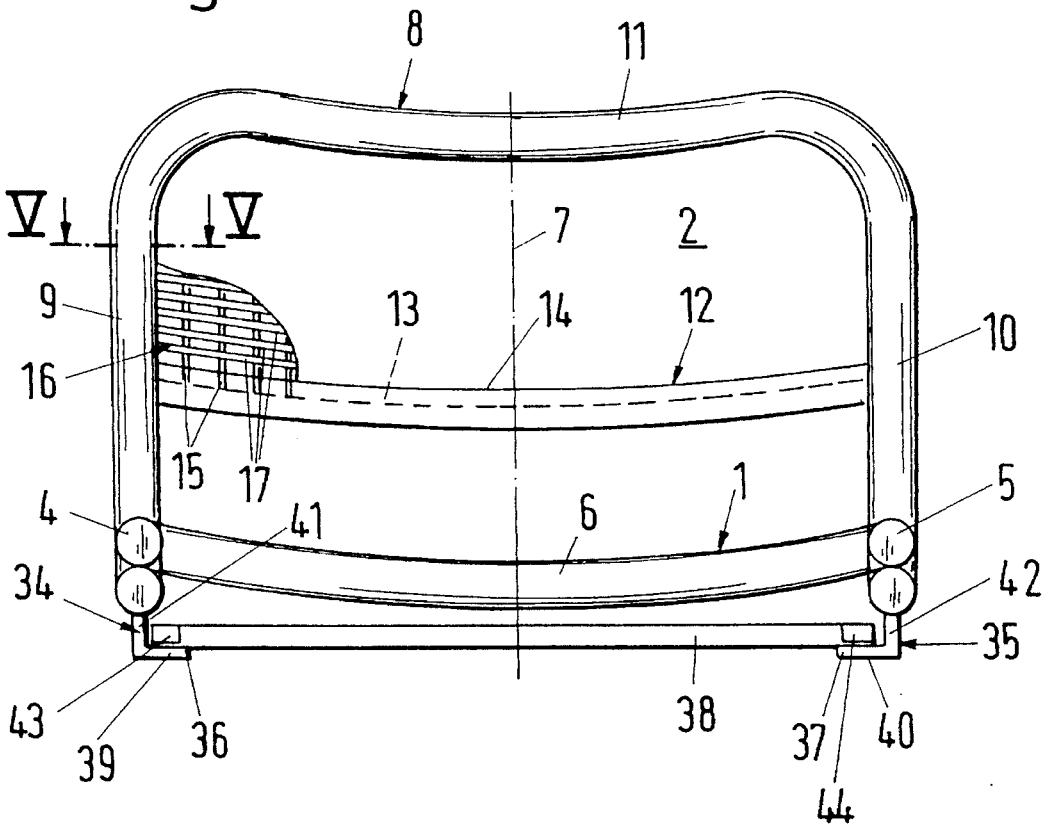
FIG. 2 shows in an enlarged representation a frontal view of the seat of FIG. 1.
Figure 3:
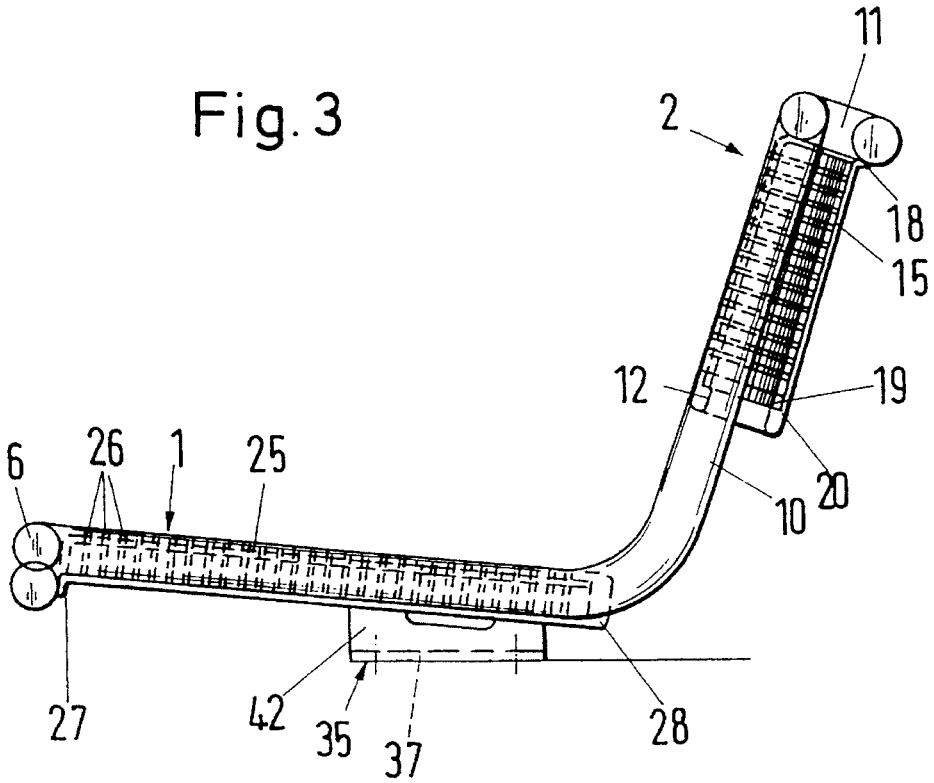
FIG. 3 shows in an enlarged representation a side view of the seat of FIG. 1.
Figure 4:
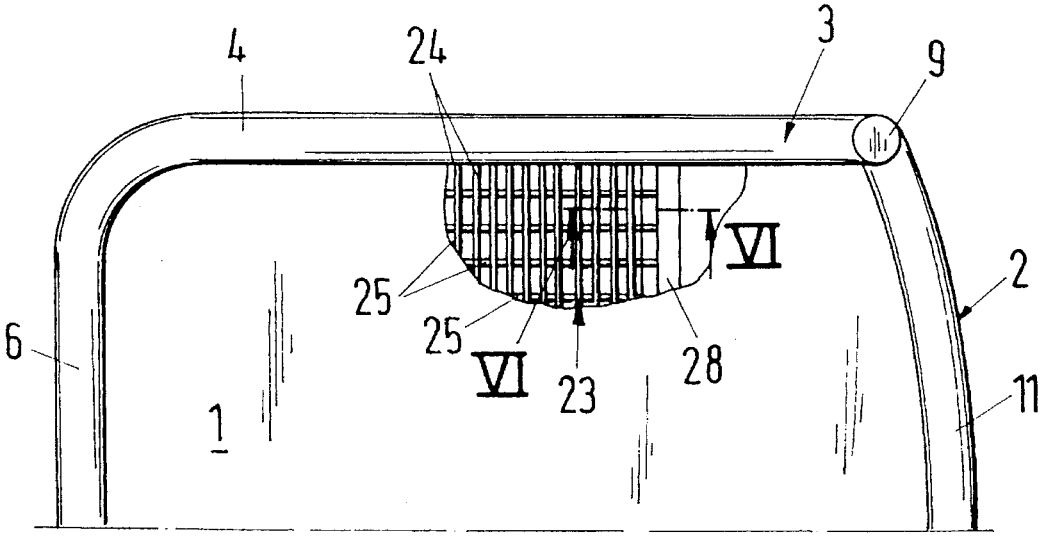
FIG. 4 shows a top view of one half of the seat of FIG. 1.

The seat has a seat portion 1 and a seat back 2. The seat portion 1 has a tubular frame (seat frame) 3 which is comprised of two lateral frame portions 4 and 5 extending parallel to one another which have a arc-shaped transition into the forward frame portion 6. The lateral frame portions 4, 5 extend straight and are slightly downwardly slanted when viewed from the forward frame portion 6 in the direction of the seat back 2 (FIG. 3). The forward frame portion 6 is concavely curved (FIG. 2) and is symmetric to the longitudinal center plane 7 (FIG. 2) of the seat. The tubular seat frame 3 has advantageously a circular cross-section so that it does not impair the comfort for a person sitting on the seat.

The tubular seat frame 3 has a transition into the tubular frame 8 of the seat back 2. The tubular frame 8 or back frame has two lateral frame portions 9 and 10 which extend straight and have a slant to the rear relative to the seat portion 1. The two lateral frame portions 9 and 10 extend in the same plane as do the respective frame portions 4, 5 of the seat portion 1. The lateral frame portions 9, 10 have a arc-shaped transition into an upward frame portion 11 which in a frontal view according to FIG. 2 is concavely curved and symmetric to the longitudinal center plane 7 of the seat, like the forward frame portion 6 of the seat portion 1. While the forward frame portion 6 of the tubular seat frame 3, when viewed in a top view of the seat portion 1 (FIG. 4), extends straight, the frame portion 11 in a top view (FIG. 4) extends arc-shaped. The radius of curvature of the frame portion 11 is designed such that the back of a person seated on the seat is provided with optimum support by the seat. The upper frame portion 11 is positioned, as shown in FIG. 3, in a plane that extends perpendicular to a plane formed by the lateral frame portions 9, 10 of the seat back 2.

In order for a person seated on the seat to be optimally and anatomically correctly supported, the frame portions 6 and 11 of the seat portion 1 and the seat back 2 have a different curvature. The forward frame portion 6 which is bent downwardly (FIG. 2 and FIG. 3) has a greater radius of curvature than the upper frame portion 11.

Figure 6:
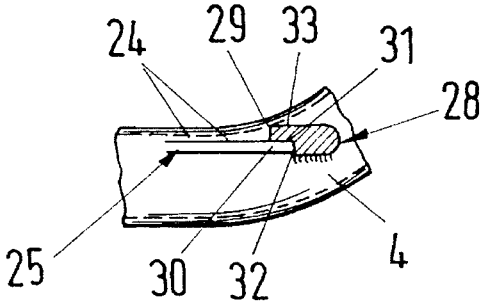
FIG. 6 shows a section along the line VI—VI in FIG. 4.

The lateral frame portions 9, 10 of the tubular frame 8 are connected at about half their height by a transverse stay 12 (FIG. 2), the ends of which are connected to the sides of the frame portions 9, 10 facing one another, preferably by welding. The transverse stay 12, as can be seen in FIGS. 2 and 6, has a rectangular cross-section. At its back side facing away from the seat portion 1 the stay 12 is provided with a depression 13 extending over its entire length. This depression 13 extends downwardly from the upper edge 14 of the transverse stay. The depth of this depression 13 corresponds at least to the diameter of the wires 15 of the wire mesh forming the back support surface 16. In the shown embodiment, this wire mesh 16 is formed by wires 15 and 17 that are substantially perpendicular to one another so as to form a crossed arrangement. The wires 15 extend from the transverse stay 12 to the upper frame portion 11 so as to be parallel to one another. The wires 17 extend between the lateral frame portions 9 and 10 of the tubular back frame 8. The back support surface 16 is curved rearwardly according to the curvature of the upper frame portion 11 (FIG. 3) whereby the curvature of the back support surface 16 is constant over its entire height. The transverse stay 12 is curved in the same direction (FIG. 3) as the upper frame portion 11. As shown in FIG. 3, the transverse stay 12 is positioned in a plane which is perpendicular to a plane in which the lateral frame portions 9, 10 are arranged. The transverse stay 12 extends parallel to the upper frame portion 11, but extends to a lesser degree to the rear than the upper frame portion 11. In a frontal view according to FIG. 2, the transverse stay 12 is convexly curved over its entire length, but is curved less than the upper frame portion 11 and the forward frame portion 6. From FIG. 2 it can be taken that the forward frame portion 6, viewed in a frontal view, is provided with a greater radius of curvature than the upper frame portion 11.

The upper ends 18 of the upwardly extending wires 15 of the back support surface 16 are bent at a right angle to the rear (FIG. 3) and are connected to the underside of the upper frame portion 11, preferably by welding. The wires 15 are positioned with their lower ends in the depression 13 of the transverse stay 12. These lower distal ends of the wires 15 are connected to the planar back side 19 of the depression 13 facing away from the seat back 2 and extending upwardly, whereby preferably welding is used for attachment (FIGS. 3 and 6). The wires 15 are advantageously of such a length that their lower ends abut on the bottom 20 of the depression 13 that extends perpendicular to the back side 19.

The upper ends 18 of the wires 15 which are also bent at a right angle extend approximately to a point of half the diameter of the upper frame portion 11. With this measure, on the one hand, they can be securely attached to the under side of the frame portion 11 and, on the other hand, they do not project past the frame portion 11 to the rear. Since the distal ends 18 of the wires 15 are connected to the underside of the frame portion 11, they must not be treated in a further working step by cutting as has been conventional for seats with wire mesh seat backs in the past. Since the distal ends 18 do not project past the frame portion 11, there is no danger that clothing could be damaged upon sitting on the seat. Since the depression 13 within the transverse stay 12 is provided at the side of the seat back facing away from the person seated thereon, the lower distal ends of the wires are also covered so that they cannot damage clothing.

Figure 5:
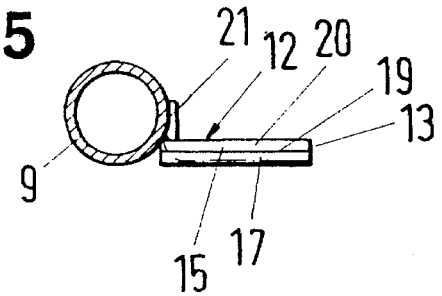
FIG. 5 shows a section along the line V—V of FIG. 2.

The wires 17 which extend substantially parallel to the transverse stay 12 are also provided on both ends with distal ends that are bent at a right angle. FIG. 5 shows one end 21 of the wire 17. The other distal end is bent accordingly at a right angle. These distal ends 21 are bent to the rear with respect to the back support surface 16 so that there is not risk of damaging clothing. These distal ends 21 are connected to the inner sides of the lateral frame portions 9 and 10 facing one another, preferably by welding. The distal ends extend over approximately a little more than half the diameter of the frame portions 9, 10 to the rear. Thus, the distal ends 21 do not project to the rear past the tubular back frame 8. Accordingly, these wires 17 must not be cut off in a separate machining step.

As shown in FIG. 5, the wires 17 of the back support surface 16 are positioned at a level of the part 20 of the transverse stay 12 having the back side 19. These wires 17 have the same radius of curvature as the transverse stay 12 so that at the transition of the transverse stay 12 to the wire mesh 16 no step is formed. The upwardly extending wires 15 are connected to the back side of the wires 17 extending away from the back support surface.

The seat surface 23 (FIG. 4) is also formed by a wire mesh which is comprised of crossed wires 24 and 25. These wires cross one another at a right angle as do the wires 15 and 17 of the back support surface 16. The wires 24 extend parallel to the forward frame portion 6 and are thus also concavely curved. These wires 24 extend between the oppositely arranged lateral frame portions 4, 5 of the tubular frame 3 (seat frame). Both ends 26 of the wires 24 are downwardly bent at a right angle and connected to facing inner sides of the lateral frame portions 4, 5. These distal ends of the wires extend about a little more than half the diameter of the lateral frame portions 4, 5 so that they do not project past the frame portions. Accordingly, the distal ends 26 must not be cut off in a separate machining/manufacturing step.

As shown in FIG. 3, the wires 24 are positioned flush with the level of the upper side of the frame portions 4, 5 so that at the transition of the frame portions to the wire mesh no step is present. The wires 17 of the back support surface 16 are positioned flush with the level of the front side of the lateral frame portions 9, 10 and the upper frame portion 11, as shown in FIG. 5, so that at the transition of the back support surface 16 into the frame portions 9 to 11 there is also no step present which would cause discomfort to a person sitting on the seat.

The wires 25 of the seat surface 23 are connected to the underside of the wires 24 by welding. Their forward ends 27, as shown in FIG. 3, are bent downwardly at a right angle and are connected to the inner side of the forward frame portion 6 facing the seat back 2. The distal ends 27 extend to about a little more than half the diameter of the frame portion 6 so that these distal ends do not project downwardly past the frame portion. Thus, these distal ends 27 also must not be cut off in a separate machining/manufacturing step.

In the area of the transition of the seat portion 1 into the seat back 2, the lateral frame portions 4, 5 of the seat portion 1 are connected by a transverse stay 28 which is advantageously embodied identical to the transverse stay 12 of the seat back 2. The transverse stay 28 is connected with its ends to the inner sides of the frame portions 4 and 5, preferably by welding. As shown in FIG. 6, the transverse stay 28 is provided at its underside with a depression 29 which extends over the entire length of the transverse stay 28 and into which the distal ends 30 of the wires 25 extend. The depth of the depression 29 corresponds to the thickness of the distal ends 30 of the wires which are connected to the back side 31 of the depression 29. Advantageously, the end faces of the distal ends 30 abut on the bottom 32 of the depression 29 which bottom 32 is perpendicular to the back side 31 of the depression 29. In the direction toward the seat surface 23 the distal ends 30 are thus covered by the portion 33 of the transverse stay 28 at which the backside 31 is provided so that there is no danger of distal ends 30 damaging clothing.

The transverse stay 28 is curved in the same manner as the forward frame portion 6 and the wires 24.

At the underside of the frame portions 4, 5 of the seat 1 two angular pieces 34 and 35 are connected (FIG. 2) which are each L-shaped. The horizontal legs 36 and 37 which are extend toward one another have connected thereto a transverse stay 38 with which the seat portion 1 is sufficiently reinforced. The legs each have at least one opening 39, 40 through which screws, threaded bolts etc. can be inserted in order to detachably connect the transverse stay 38 to the angular pieces 34, 35, whereby the transverse stay 38 rests with its ends on the legs 36, 37. Clamping brackets 43, 44 can be used for connecting which extend over the ends of the transverse stay 38 and are connected to the legs 36, 37.

The legs 41, 42 of the angular pieces 34, 35 extending at a right angle to the legs 36, 37 are connected with their end faces to the underside of the frame portions 4, 5, preferably by welding. These upwardly positioned legs 41, 42 are located at half the width of the frame portions 4, 5 so that they do not compromise comfort or appearance. As shown in FIG. 2, the transverse stay 38 is positioned in an area below the forward frame portion 6, respectively, of the seat surface 23.

Since the seat surface 23 and the back support surface 16 have a different degree of curvature, an optimal, anatomically correct adaptation to the human body and a high comfort result. Since the tubular frames 3 and 8 together form a unitary part, the complete frame structure 3, 8 is provided with only one welding location. Since the distal ends of the wires of the wire mesh forming the back support surface 16 and the seat surface 23 do not rest on the tubular frame 3 or 8, many advantages result with respect to the manufacture of the seat. For example, the coating of the tubular frame can be substantially thinner because the wire ends must no longer be cut off.

The wire mesh preferably has rectangular mesh openings which result in an especially high seat comfort. Of course, the wire mesh can have any other suitable structure. The angular pieces 34, 35 can be constructed differently with respect to a support structure to which the seat is connected.

The described seat is a seat shell that can be connected to a support, a support frame or can also be connected to the wall.

The present invention is, of course, in no way restricted to the specific disclosure of the specification and drawings, but also encompasses any modifications within the scope of the appended claims.

What I claim is:

1. A seat comprising:

a seat portion having a seat frame and a seat surface comprised of a first wire mesh;

a seat back having a back frame and a back support surface comprised of a second wire mesh;

wherein said first wire mesh is comprised of first wires with distal ends;

wherein said seat frame has inner sides facing one another;

wherein said distal ends of said first wires are directly connected to said inner sides of said seat frame;

wherein said second wire mesh is comprised of second wires with distal ends;

wherein said back frame has inner sides facing one another;

wherein said distal ends of said second wires are directly connected to said inner sides of said back frame;

wherein said seat frame comprises a forward frame portion and lateral frame portions, connected to said forward frame portion, and a transverse stay connected between said lateral frame portions, said transverse stay delimiting said seat surface relative to said seat back;

wherein said first wires are comprised of a first set and a second set, wherein said distal ends of said first set, that extend away from said forward frame portion, are directly connected to said transverse stay; and wherein said transverse stay, on a side thereof facing away from said seat surface, has a depression into which depression said distal ends of said first set extend.

2. A seat according to claim 1, wherein said distal ends of said first and said second wires are bent substantially at a right angle to form a bent portion.

3. A seat according to claim 2, wherein said distal ends of said second wires are bent rearwardly.

4. A seat according to claim 2, wherein said distal ends of said first wires are bent downwardly.

5. A seat according to claim 2, wherein said bent portion of said distal ends extend substantially over half a thickness of said seat frame and said back frame.

6. A seat according to claim 1, wherein said depression has a depth equal to a thickness of said distal ends of said set extending into said depression.

7. A seat according to claim 1, wherein said back frame comprises an upward frame portion and lateral frame portions, connected to said upward frame portion, and a transverse stay connected between said lateral frame portions, said transverse stay delimiting said back support surface relative to said seat portion.

8. A seat according to claim 7, wherein said second wires are comprised of a first and a second set, wherein said distal ends of said wires of said first set that extend away from said upward frame portion are connected to said transverse stay.

9. A seat according to claim 8, wherein said transverse stay, on a side thereof facing away from said back support surface, has a depression into which depression said distal ends of said first set that extend away from said upward frame portion extend.

10. A seat according to claim 9, wherein said depression has a depth equal to a thickness of said distal ends of said set extending into said depression.

11. A seat according to claim 7, wherein said upward frame portion and said forward frame portion are curved with different curvatures.

12. A seat according to claim 11, wherein said seat frame and said back frame together are a unitary part.

13. A seat according to claim 7, wherein said upward frame portion has a smaller radius of curvature than said forward frame portion.

14. A seat according to claim 7, wherein said transverse stay of said seat portion extends in a plane parallel to said forward frame portion.

15. A seat according to claim 13, wherein said transverse stay of said seat back extends in a plane parallel to said upward frame portion.

16. A seat according to claim 11, wherein said seat surface has the same radius of curvature as said forward frame portion.

17. A seat according to claim 11, wherein said back support surface has the same radius of curvature as said upward frame portion.

18. A seat according to claim 7, wherein said lateral frame portions of said seat frame and said lateral frame portions of said back frame are arranged in common vertical planes.

19. A seat according to claim 7, wherein said lateral frame portions of said seat frame have an arc-shaped transition into said lateral frame portions of said back frame.

20. A seat according to claim 1, wherein said forward frame portion, when viewed in a top view of said seat surface, extends straight.

* * * * *